US007619534B2

(12) United States Patent
Barrieau et al.

(10) Patent No.: US 7,619,534 B2
(45) Date of Patent: Nov. 17, 2009

(54) METHOD AND APPARATUS FOR DETECTION OF HAZARDOUS OR POTENTIALLY HAZARDOUS CONDITIONS

(75) Inventors: Mark P. Barrieau, Baldwinville, MA (US); Donal D. Brighenti, Westminster, MA (US)

(73) Assignee: SimplexGrinnell LP, Westminster, MA (US)

( * ) Notice: Subject to any disclaimer, the term of this patent is extended or adjusted under 35 U.S.C. 154(b) by 360 days.

(21) Appl. No.: 11/522,671

(22) Filed: Sep. 18, 2006

(65) Prior Publication Data

US 2007/0296570 A1 Dec. 27, 2007

(51) Int. Cl.
*G08B 17/12* (2006.01)

(52) U.S. Cl. ..... 340/577; 340/628; 340/521; 700/245

(58) Field of Classification Search ..... 340/525, 340/521, 577, 628; 700/245, 253
See application file for complete search history.

(56) References Cited

U.S. PATENT DOCUMENTS 4,638,445 A * 1/1987 Mattaboni ..... 701/23
4,857,912 A * 8/1989 Everett et al. ..... 340/508
4,862,141 A * 8/1989 Jordal ..... 340/521
6,907,388 B2 * 6/2005 Suzuki et al. ..... 702/188
6,989,756 B2 * 1/2006 Rhodes et al. ..... 340/628
7,332,890 B2 * 2/2008 Cohen et al. ..... 320/109
2001/0013828 A1 * 8/2001 Geerts ..... 340/541
2004/0073337 A1 * 4/2004 McKee et al. ..... 700/245
2006/0017547 A1 * 1/2006 Buckingham et al. ..... 340/328

* cited by examiner

*Primary Examiner*—Daniel Wu
*Assistant Examiner*—Hongmin Fan
(74) *Attorney, Agent, or Firm*—The Small Patent Law Group

(57) ABSTRACT

A fire alarm system includes a fire alarm control panel (FACP) and an addressable signaling line circuit (SLC) operably coupled to the FACP for communicating with addressable components, including a plurality of sensors. The sensors can include a plurality of atmospheric sensors operably coupled to the SLC and each configured to provide information about their local atmospheric environment. Also provided is a mobile robot addressable and dispatchable by the fire alarm control panel (FACP) to an area indicated by sensors that are detecting a hazardous or potentially hazardous condition. The robot has mobile sensors that are configured to obtain verification of the hazardous or potentially hazardous condition and the robot is further configured to communicate the verification to the FACP.

18 Claims, 4 Drawing Sheets

METHOD AND APPARATUS FOR DETECTION OF HAZARDOUS OR POTENTIALLY HAZARDOUS CONDITIONS

BACKGROUND OF THE INVENTION

This invention relates generally to fire detection and extinguishing equipment, and more particularly, to methods and apparatus for confirming the presence of a fire or of smoldering materials.

A modem addressable fire alarm control panel (FACP) may have one or more channels of addressable initiating devices for automatic detection of fire. An automatic alarm may be initiated by smoke sensors, heat sensors, or other sensors. These sensors may be analog or digital sensors, but most frequently are analog sensors. The sensors constantly measure ambient conditions and report changes back to the FACP that relate to smoke obscuration, carbon monoxide (CO) content, temperature, etc., depending on the sensor type. For example, a smoke sensor might send back a "clean air" analog value of "72," which, for this particular sensor, may represent a smoke obscuration of 0% per foot. An alarm value for smoke sensors is often set to an obscuration percentage of 2.5% or 3.5% per foot. An alarm analog value is usually represented by a higher analog value than the clean air value. A scale can be used to relate the analog readings to percent smoke obscuration. For example, one known automatic alarm system uses 27 least significant bit (LSB) "ticks" to represent 1% smoke obscuration (i.e., a value of "99").

Because the alarm value is typically set to 2.5% or 3.5%, the sensor reading required for an alarm may be in the range of 139-166. The setting of a higher alarm threshold tends to prevent dispatching the fire department to investigate nuisance conditions that are not real alarms. Because of the very strong desire to avoid false alarms, very early detection of smoldering material, for example, may sometimes be limited. Some methods have been introduced to reduce the occurrence of false alarms, however, such methods require additional smoke or smoke for a longer period than is required for early detection of smoldering material for an alarm to be initiated. Other methods in which multiple fixed sensors are used to make early alarm decisions are limited in that only one sensor may be close enough to the source to detect early stage combustion.

BRIEF DESCRIPTION OF THE INVENTION

In one aspect, some configurations of the present invention provide a fire alarm system. The fire alarm system includes a fire alarm control panel (FACP) and an addressable signaling line circuit (SLC) operably coupled to the FACP for communicating with addressable components, including a plurality of sensors. The sensors can include a plurality of atmospheric sensors operably coupled to the SLC and each configured to provide information about their local atmospheric environment. Also provided is a mobile robot addressable and dispatchable by the fire alarm control panel (FACP) to an area indicated by sensors that are detecting a hazardous or potentially hazardous condition. The robot has mobile sensors that are configured to obtain verification of the hazardous or potentially hazardous condition and the robot is further configured to communicate the verification to the FACP.

In another aspect, some configurations of the present invention provide a mobile robot addressable and dispatchable by a fire alarm control panel (FACP) to an area indicated by local atmospheric sensors as having a hazardous or potentially hazardous condition. The robot has mobile sensors that are configured to obtain verification of the hazardous or potentially hazardous condition and the robot is further configured to communicate the verification to the FACP.

In yet another aspect, some configurations of the present invention provide a method for detecting a hazardous or potentially hazardous condition. The method includes detecting a signal from a sensor capable of providing information about local atmospheric conditions in a room, dispatching a mobile robot to a room in which a signal was received from the sensor before a pre-set alarm trip point is reached, and using mobile sensors on the robot to confirm that a hazardous or potentially hazardous condition exists.

It will be appreciated that some configurations of the present invention provide early detection of an alarm by verification of any unusual increase in sensor readings sent back from installed smoke, heat, CO and other alarm devices installed in a building. In many instances, a fire may also be extinguished before becoming extremely dangerous or life-threatening, because it takes much less extinguishing agent to extinguish a fire detected at a very early stage.

Figure 1:
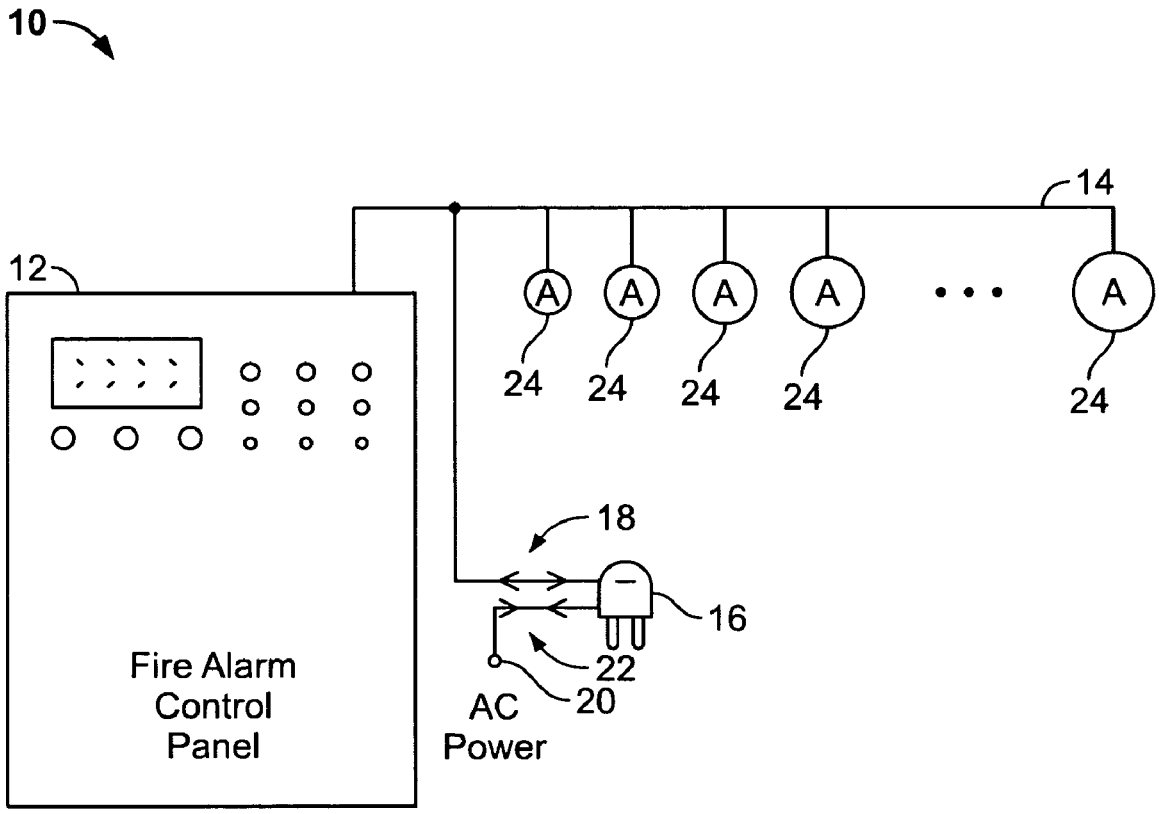
FIG. 1 is a schematic block drawing of one configuration of a fire alarm system in accordance with an embodiment of the present invention.

It will become apparent that various configurations of the present invention permit the reliable detection of an alarm at a very early stage, and allow for the possibility of automatically extinguishing a fire at this early stage.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block of random access memory, hard disk, or the like). Similarly, the programs may be stand alone programs, may be incorporated as subroutines in an operating system, may be functions in an installed software package, and the like. It should be understood that the various embodiments are not limited to the arrangements and instrumentality shown in the drawings.

DETAILED DESCRIPTION OF THE INVENTION

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property. Also, sensors on a mobile robot may be referred to as "mobile sensors" to help distinguish such sensors from, for example, atmospheric sensors affixed to a ceiling or wall. Furthermore, "local atmospheric conditions" refers to conditions in the immediate vicinity of a particular atmospheric sensor.

In some configurations of the present invention and referring to FIG. 1, a fire detection system 10 having a fire alarm control panel (FACP) 12 and an addressable signaling line circuit (SLC) 14, is provided, along with various addressable components, which may include one or more programmable mobile robots 16 and other devices 24. These other devices may include sensors capable of providing information about the local atmospheric environment ranging from "clean air" through a smoke condition that signals an alarm. Optionally, the other devices 24 may include a door access system. Robot 16 is electrically addressable via, for example, a mating connector pair 18 such as a plug/socket arrangement, that disconnects when robot 16 moves from its standby location to another area. Other types of connections, including radio communication links, may be used instead of or in addition to mating connector pair 18. Upon moving to another area, communication with SLC 14 may be accomplished in a number of different ways that may depend upon circumstances and/or the particular configuration of system 10, as discussed in more detail below. AC power 20 is provided for charging of a battery in robot 16. When robot 16 leaves its storage location, AC power is disconnected by the separation of mating connector pair 22. Robot 16 may be provided with some degree of immunity to harsh environments, but no great degree of protection is required, as robot 16 need only be dispatched into the beginning stages of a fire, as described below.

Mobile fire alarm robot 16 is an addressable component of the fire alarm system, and robot 16 has its own mobile sensors that can be carried from a central, standby location to a location in a building where hazardous or potentially hazardous conditions are sensed.

Figure 2:
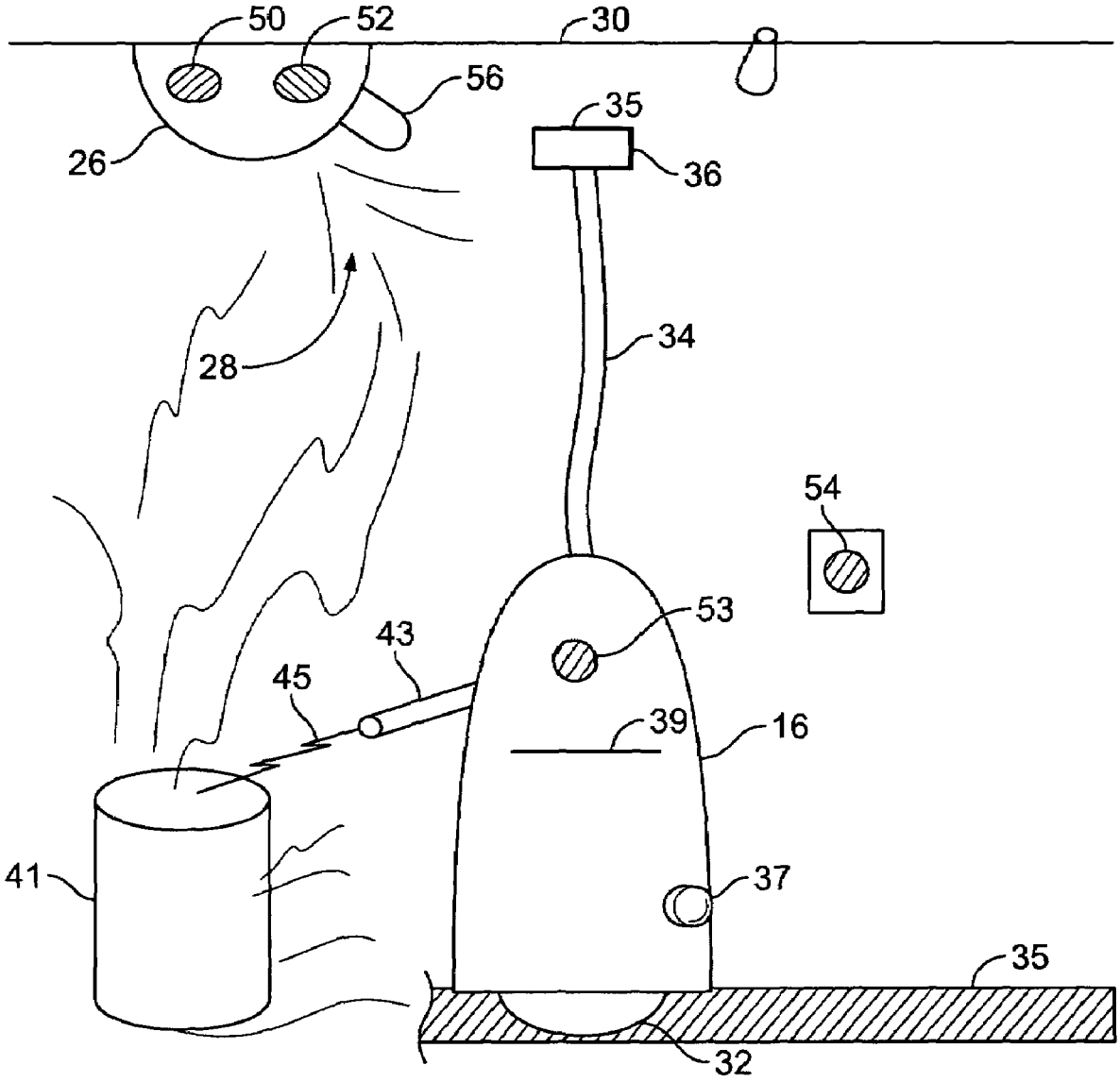
FIG. 2 is a pictorial drawing of the robot shown in FIG. 1 deployed to a hazardous or potentially hazardous situation.
Figure 3:
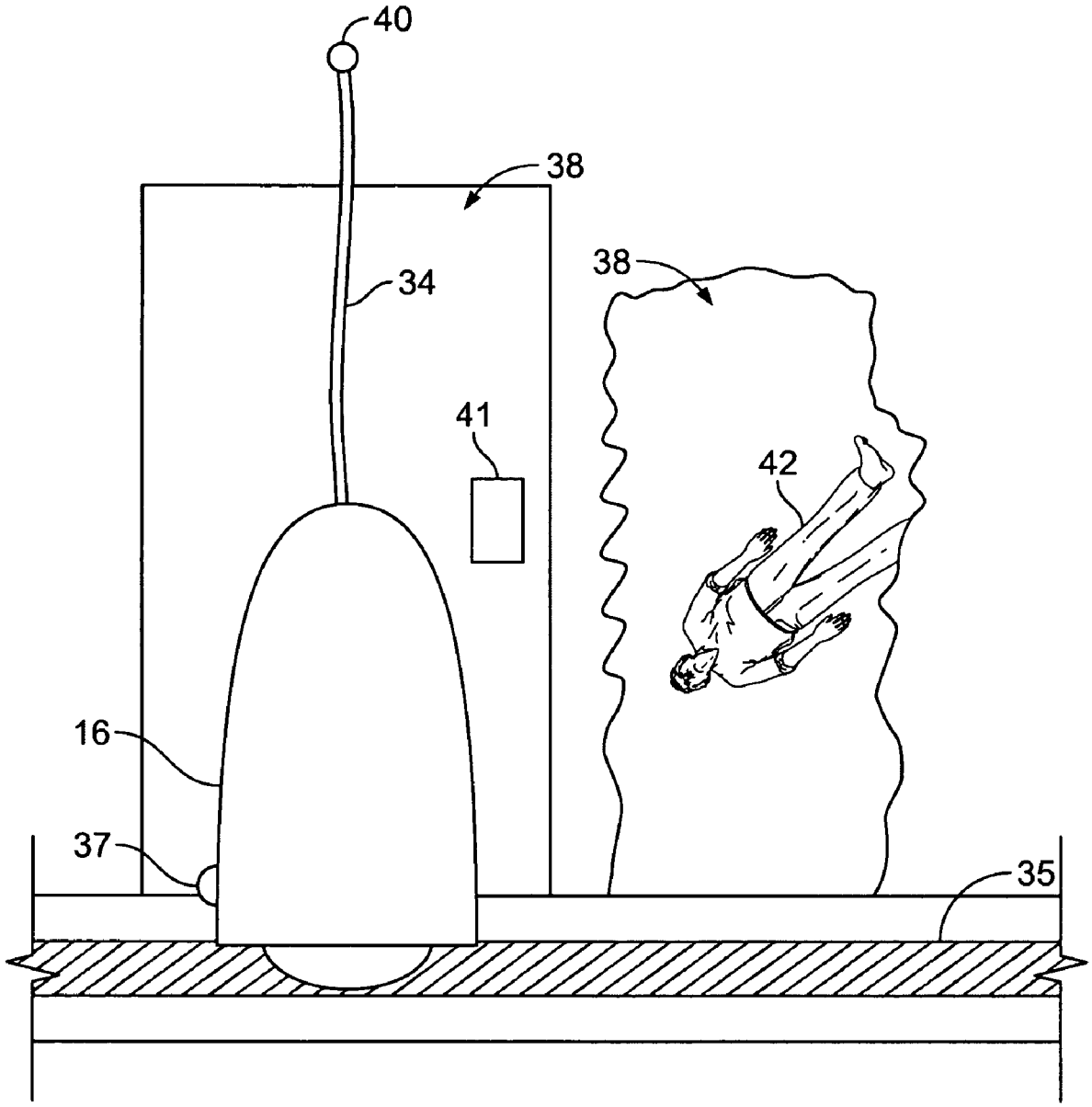
FIG. 3 is a pictorial drawing of the robot shown in FIG. 1 deployed to a hotel room to investigate a hazardous or potentially hazardous situation.

In some configurations and referring to FIG. 2, sensors 26 detect unusual obscuration values well before a pre-set alarm trip point is reached. For example, a smoldering fire might initially produce a very low level of smoke 28, but this level increases as the fire spreads and as more fuel is combusted. A nearby sensor 26 might detect the increase in smoke 28, but would typically take no action unless the smoke level reached the pre-set trip point. At the very early stages of the fire, perhaps only the nearest sensor 26 would experience the slight increase in smoke obscuration.

To check whether there is actually a fire at a very early stage, robot 16 is dispatched by FACP 12 to a location near the sensor 26 experiencing the slight increase in smoke obscuration. Robot 16 proceeds via wheels or rollers 32 to the area at which the smoke, heat, and/or gas level was detected. Optionally, guide markers, such as invisible ultraviolet (UV) colored tracks 35, can be laid down main hallways to guide robot 16 using, for example, mobile UV sensors 37. Because the level of smoke, heat, and/or gas detected is lower than the alarm level, it may not yet be appropriate to summon the fire department or other emergency responders. However, when robot 16 arrives, it deploys its own mobile sensors 36 to obtain verification of a hazardous or potentially hazardous condition. For example, robot 16 can deploy a mobile combination sensor 36 to ceiling 30 level using a telescoping pole 34. If the smoke level (or other condition) is confirmed as reported, robot 16 can send a verification report to FACP 12. For example, a magnet 35 on top of pole 34 can send a message to FACP 12, as many hotel and industrial smoke sensors 26 have internal reed switches that can be activated magnetically to provide a test signal that can be communicated to FACP 12. As another example, a message could be sent from robot 16 to FACP 12 via radio.

Robot 16 may also use its mobile sensors to attempt to home in more closely on a location as another way to verify hazardous or potentially hazardous conditions where a detected level is below a verification threshold. Robot 16 brings additional detection and verification capability right to the source of the hazardous or potentially hazardous condition.

Additionally, robot 16 may be supplied with an extinguishing agent 45 that can be expelled in the direction of a fire or smoldering embers. Only a small quantity of extinguishing agent 45 is required, because robot 16 would normally detect a fire in its earliest stages. An infrared sensor and/or a carbon monoxide (CO) sensor 39, for example, can be used to find the source of combustion 41.

Robot 16 can be configured to use fire alarm system 10, including FACP 12, to reduce the level of autonomy necessary for robot 16. Many sensors 26 already include piezoelectric sounders 50 to alert occupants, but an ultrasonic device 52 could be installed instead of, or in addition to, the regular audible piezoelectric sounder. For example, a sensor 26 that initiates a robot dispatch may emit an ultrasonic homing signal that does not disturb the occupants of the room, but that could be used by an ultrasonic detector 53 on robot 16 to navigate to an area of concern. Additionally, robot 16 could communicate to FACP 12 using installed sensors, such as infrared ports 54, or communicate with a sensor 26 using visible or infrared light emission. For example, many sensors 26 have infrared light emitting diodes 56 that indicate the condition of the sensor. Information could be downloaded from a sensor 26 to a robot 16 using LEDs 56.

By verifying that the slight increase in smoke (or heat, etc.) is due to a fire, robot 16 provides very early notification. Thus, emergency personnel can be summoned sooner, reducing the danger to life and property.

In a configuration useful in a hotel, a robot 16 can be dispatched to a particular room 38. Upon arrival, robot 16 can access a door port 40 enabling heat and smoke sampling inside room 38. Door port 40 may be a hole or other opening through which robot 16 can insert a sensor, possibly on pole 34. Door port 40 may be located near the ceiling and covered by a spring-loaded closing mechanism, for example, to prevent unauthorized use of the port and to protect the privacy of room occupants.

When no heat is present and smoke is detected by robot 16, robot 16 may request and be granted access to the room using the door access system 41 commonly used by hotels for Ving card keys. In some instances, it may be preferred never to open a door, and robot 16 may be configured in this manner if appropriate. If heat is present, robot 16 can contact FACP 12 so that an alarm would be initiated. Once inside room 38, robot 16 could extinguish a small fire or signal FACP 12 to sound a general alarm. Additionally, robot 16 may be programmed to rouse a sleeping or passed-out occupant 42. Optionally, robot 16 can be equipped with a camera 44 having video or still photography capabilities to record all or some of its actions.

Robot 16 may normally be attached to an AC power source 20 and a wired communications interface 18, allowing the monitoring and charging of storage batteries in robot 16. Any robot 16 faults can be monitored by FACP 12 and/or by robot 16, itself. When dispatched, robot 16 disengages from the wired interfaces 18 and 22 and proceeds as directed. Robot 16, in some configurations, may use the installed fire alarm system 10 as an aid in navigating to a suspected fire source, thus increasing the speed at which robot 16 could travel to the source, and reducing the level of autonomy required of robot 16.

In certain embodiments, multiple robots 16 may be utilized and assigned to specific areas, in order to decrease response time. For example, a robot 16 may be provided for each floor of a hotel or other multistory structure.

Figure 4:
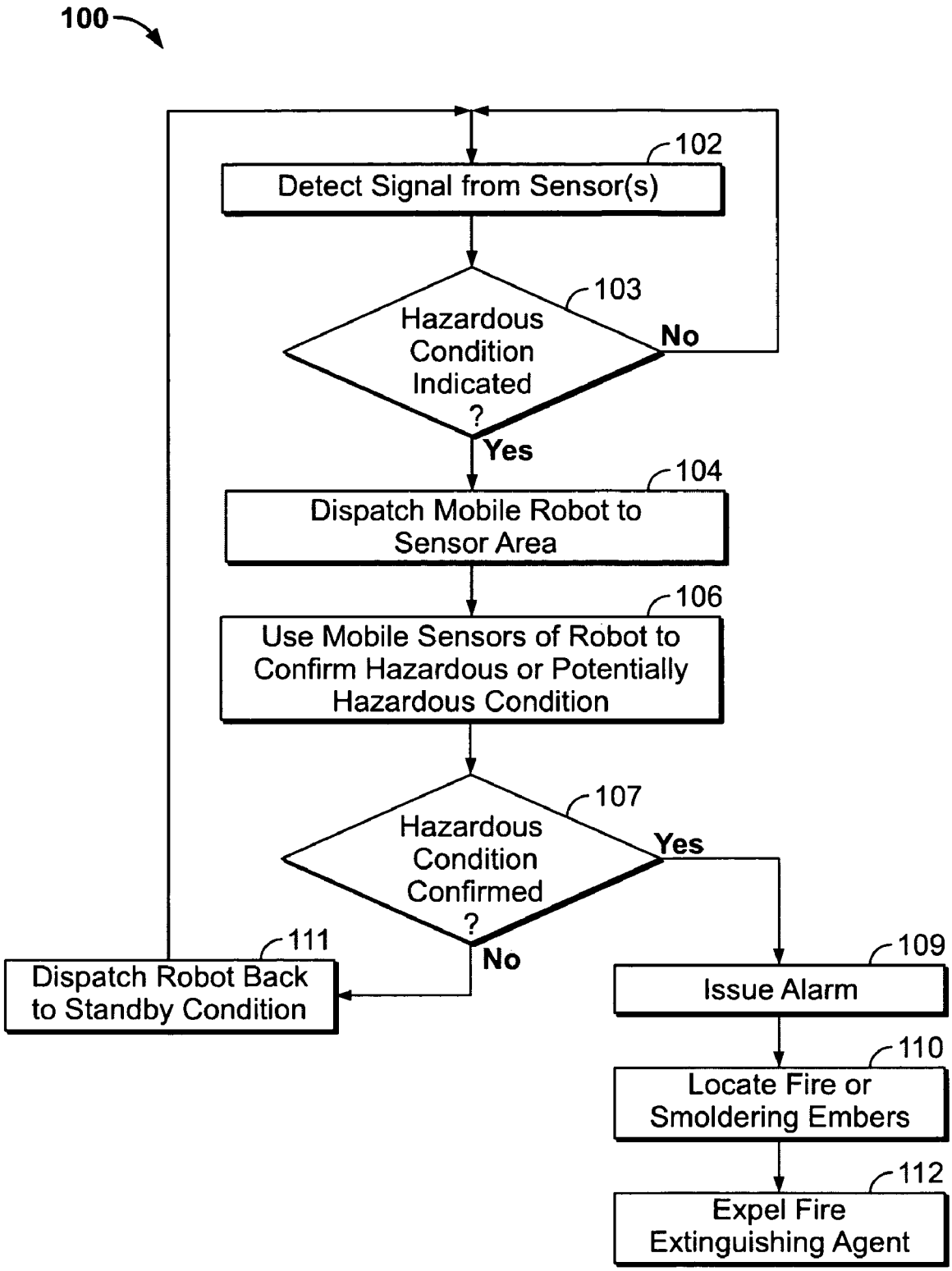
FIG. 4 is a flow chart representing a method configuration in accordance with an embodiment of the present invention.

FIG. 4 illustrates a flowchart 100 to provide a method for detecting a hazardous or potentially hazardous condition in accordance with at least one embodiment. The FACP 12 detects a signal from a sensor 26 at block 102. This sensor is capable of providing information about local atmospheric conditions in a room, for example, obscuration caused by smoke from a fire or smoldering embers.

While no signal indicative of a hazardous or potentially hazardous condition is detected at 103, block 102 is repeated. If such a signal is detected at 103, but before a pre-set alarm trip point is reached, FACP 12 dispatches a mobile robot 16 to the room from which the signal was received from sensor 26 at block 104. By dispatching robot 16 at this early stage, it may be possible to confirm the existence of a fire at a time when it is less hazardous and can easily be put out, or confirm that there is no fire and avoid having to issue a false alarm.

Next, at block 106, mobile sensors on robot 16 are used to confirm that a hazardous or potentially hazardous condition does or does not exist. For example, robot 16 can raise an obscuration sensor 36 to the ceiling 30 to confirm the obscuration signal produced by sensor 26. If confirmation is made at block 107, an alarm may be issued by FACP 12 at block 109. Otherwise, robot 16 can be dispatched back to its standby position at block 111, while FACP 12 continues to monitor signals from the sensors in case subsequent signals from sensor 26 indicate an actual situation that could not be detected by robot 16, or another condition needing robot 16 for confirmation.

In some configurations, the robot 16 may be equipped with extinguishing agent and the hazardous or potentially hazardous condition may constitute the early stage of a fire. Thus, the method can further include, at block 110, utilizing mobile sensors on robot 16 to locate the fire or smoldering embers, and at block 112, expelling the extinguishing agent from the robot in the direction of the fire or the smoldering embers.

Some configurations of the present invention include additional preliminary steps at block 102 or prior to block 102. More particularly, in a normal standby mode, robot 16 is attached to an AC power line 20 prior to block 102, which powers the robot and recharges its batteries. FACP 12 communicates with all detection devices 26 at block 102. Robot 16 may also answer attendance and status polls from FACP 12 at block 102 in some configurations. Optionally, dispatching robot 16 at block 104 may include detaching robot 16 from AC power.

In some configurations of the present invention, SLC 14 can be, but need not be, IDNet wiring, which is a simplex proprietary wired communication channel available from Tyco Fire & Security, Westminster, Mass. Other types of wired networks may also be used. Radio frequency (RF) communication may be used as an alternative or in addition to a wired network, if reception conditions inside the building in which system 10 is deployed permit.

FACP 12 may be, but need not be, a model 4100U FACP, also available from Tyco Fire & Security, Westminster, Mass. In some configurations, FACP 12 can assist in a homing operation of robot 16. For example, commands from FACP 12 can activate sensors and/or devices that can be sensed by robot 16 to guide its path to a suspected alarm. Also, sensors placed along the possible paths of robot 16 can assist FACP 12 in tracking robot 16. For example, IR sensors could detect an infrared signal emitted by robot 16, or robot 16 could activate reed switches along its route to send information to FACP 12.

It will thus be appreciated that various configurations of the present invention provide early detection of an alarm by verification of any unusual increase in sensor readings sent back from installed smoke, heat, CO and other alarm devices installed in a building. In many instances, a fire may also be extinguished before becoming extremely dangerous or life-threatening, because it takes much less extinguishing agent to extinguish a fire detected at a very early stage.

While the invention has been described in terms of various specific embodiments, those skilled in the art will recognize that the invention can be practiced with modification within the spirit and scope of the claims.

What is claimed is:

1. A fire alarm system comprising:

a fire alarm control panel (FACP);

an addressable signaling line circuit (SLC) operably coupled to the FACP for communicating with addressable components, including a plurality of sensors;

a plurality of atmospheric sensors operably coupled to the SLC and each configured to provide a potential hazard signal representative of a potentially hazardous condition, wherein said plurality of atmospheric sensors comprise magnetically activated switches; and a mobile robot configured to be addressed and dispatched by said fire alarm control panel (FACP) when the sensors generate the potential hazard signal, to an area indicated by said sensors detecting the potentially hazardous condition, the FACP dispatching the mobile robot to the area before the FACP activates a pre-set alarm, said robot having mobile sensors configured to obtain verification of the potentially hazardous condition, said mobile sensors comprising a magnet configured to activate said magnetically activated switches, to communicate a mobile sensor signal verification to the FACP, the FACP issuing an alarm signal when the FACP receives the mobile sensor signal verification.

2. A system in accordance with claim 1 wherein said robot further comprises a mobile combination sensor on a telescoping pole, said mobile combination sensor deployable to ceiling level.

3. A system in accordance with claim 1 wherein said robot further is supplied with an extinguishing agent and a mobile sensor configured to find a source of combustion, and said robot is configured to extinguish the source of combustion using said extinguishing agent.

4. A system in accordance with claim 1 wherein said atmospheric sensors further comprise a homing signal emitter and said robot further comprises a mobile detector configured to detect a homing signal emitted by said homing signal emitter so that the robot can navigate to the location of at least one of the atmospheric sensors.

5. A system in accordance with claim 4 wherein said homing signal emitter emits an ultrasonic homing signal.

6. A system in accordance with claim 1 installed in a building and further wherein rooms of said building are provided with door ports or openings through which said robot can insert a mobile sensor.

7. A system in accordance with claim 6 wherein access to said rooms is provided by a door key system, wherein said door key system is configured to grant access to said robot when smoke is detected by said robot.

8. A system in accordance with claim 1 wherein said robot further comprises a camera configured to record all or some of the actions of said robot.

9. A system in accordance with claim 1 wherein said robot is provided with mobile sensors configured to follow guide markers.

10. A system in accordance with claim 9 wherein said guide markers comprise ultraviolet (UV) colored tracks, and said mobile sensors configured to follow guide markers comprise mobile UV sensors.

11. A mobile robot addressable and dispatchable by a fire alarm control panel (FACP) to an area indicated by local atmospheric sensors each configured to provide a potential hazard signal representative of a potentially hazardous condition, said robot configured to be addressed and dispatched by the FACP, when the sensors generate the potential hazard signal, to an area before said FACP activates a pre-set alarm, said robot having mobile sensors configured to obtain verification of the potentially hazardous condition and further configured to communicate the mobile sensor verification to the FACP, said mobile sensors including a magnet configured to activate magnetically activated switches to send a mobile sensor signal verification to the FACP, the FACP issuing an alarm signal when the FACP receives the mobile sensor signal verification.

12. A robot in accordance with claim 11 wherein said mobile sensors further comprise a mobile sensor configured to obtain verification of an obscuration condition.

13. A robot in accordance with claim 11 wherein said robot further comprises a mobile combination sensor on a telescoping pole, said mobile combination sensor deployable to ceiling level.

14. A robot in accordance with claim 11 wherein said robot further is supplied with an extinguishing agent and a mobile sensor configured to find a source of combustion, and said robot is configured to extinguish the source of combustion using said extinguishing agent.

15. A robot in accordance with claim 11 wherein at least one atmospheric sensor comprises a homing signal emitter, said robot further comprises a mobile detector configured to detect a homing signal emitted by the homing signal emitter so that the robot can navigate to the location of the at least one atmospheric sensor.

16. A method for detecting a hazardous or potentially hazardous condition, said method comprising:

detecting a signal from a sensor capable of providing a potential hazard signal representative of a potentially hazardous condition;

dispatching a mobile robot to a room in which the potential hazard signal was received to verify the potentially hazardous condition before the FACP activates a pre-set alarm; and using mobile sensors on the mobile robot to confirm that the potentially hazardous condition does or does not exist, the mobile sensors including a magnet configured to activate magnetically activated switches to communicate a mobile sensor verification to the FACP, the FACP issuing an alarm when the FACP receives the mobile sensor verification.

17. A method in accordance with claim 16 wherein the hazardous or potentially hazardous condition is an early stage of a fire, and said method further comprises utilizing mobile sensors on the robot to locate the fire or smoldering embers, and expelling an extinguishing agent from the robot in the direction of the fire or the smoldering embers.

18. A system in accordance with claim 1 wherein said pre-set alarm represents a point at which the FACP issues an alarm to an external emergency service.

* * * * *

UNITED STATES PATENT AND TRADEMARK OFFICE

CERTIFICATE OF CORRECTION

PATENT NO. : 7,619,534 B2
APPLICATION NO. : 11/522671
DATED : November 17, 2009
INVENTOR(S) : Barrieau et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 420 days.

Signed and Sealed this

Twenty-sixth Day of October, 2010

David J. Kappos

David J. Kappos
*Director of the United States Patent and Trademark Office*